US005628165A

United States Patent [19]

Long et al.

[11] Patent Number: 5,628,165

[45] Date of Patent: May 13, 1997

[54] METHOD OF PACKAGING AN ARTICLE

[75] Inventors: Michael Long, Rochester; James A. White, Conesus, both of N.Y.

[73] Assignee: Eastman Kodak Company, Rochester, N.Y.

[21] Appl. No.: 623,472

[22] Filed: Mar. 28, 1996

[51] Int. Cl.[6] ..... B65B 47/00

[52] U.S. Cl. ..... 53/453; 53/454

[58] Field of Search ..... 53/900, 559, 560, 53/553, 555, 453, 454

[56] References Cited

U.S. PATENT DOCUMENTS

| | | | |
|---|---|---|---|
| 2,503,518 | 4/1950 | Slaughter | 53/454 X |
| 2,579,415 | 12/1951 | Carson | 53/453 |
| 2,608,405 | 8/1952 | Salfisberg et al. | 53/560 X |
| 2,896,387 | 7/1959 | Brock . | |
| 2,896,943 | 7/1959 | Lewi . | |
| 2,928,221 | 3/1960 | Smith . | |
| 2,935,227 | 5/1960 | Swartz | 53/555 X |
| 3,011,678 | 12/1961 | McClosky et al. | 53/555 X |
| 3,557,517 | 1/1971 | Limmer . | |
| 4,034,536 | 7/1977 | Mahaffy et al. . | |
| 4,133,162 | 1/1979 | Baumstingl . | |
| 4,466,229 | 8/1984 | Gino | 53/559 |
| 4,494,361 | 1/1985 | Barathon et al. | 53/559 X |
| 4,604,852 | 8/1986 | Becker | 53/453 X |
| 4,959,115 | 9/1990 | Lacy . | |
| 5,121,588 | 6/1992 | Abate . | |
| 5,146,730 | 9/1992 | Sadek et al. | 53/454 |

*Primary Examiner*—Daniel Moon
*Attorney, Agent, or Firm*—Clyde E. Bailey, Sr.

[57] ABSTRACT

A method of packaging an article includes tensioning first and second webs enveloping an article seated in one of a plurality of through openings. The webs are sequentially supplied to at least one through opening and the article to be packaged is, in sequence, inserted between the first and second webs. Once the article is generally overwrapped by the first and second webs, overhanging portions of webs about the article are sealed thereby forming a packaged article. The packaged article is then relieved from the through opening by preferably cutting or punching it through the opening.

5 Claims, 8 Drawing Sheets

METHOD OF PACKAGING AN ARTICLE

DESCRIPTION

1. Field of the Invention

The invention relates generally to a method of packaging an article. More particularly, the invention concerns a method of packaging an article with tensioned webs sequentially overwrapping the article seated in a through opening.

2. Background of the Invention

Numerous prior art patents have attempted to solve the packaging pitch registration problems associated with metering a product to be packaged onto a web, sealing a second web to the first and thereby enveloping the product then singulating the packaged product. Brock U.S. Pat. No. 2,896,387; Smith U.S. Pat. No. 2,928,221; Lewi U.S. Pat. No. 2,896,943; and Mahaffy U.S. Pat. No. 4,034,536 add the additional essential steps of heating and thornreforming a pocket in one or both packaging webs to prevent product migration on the lower web as it is transported between the tilling and sealing stations. Baumstingl U.S. Pat. No. 4,133,162 and Limmer U.S. Pat. No. 3,557,517 add the additional essential steps of introducing mold cavities which move with the packaging web through the filling, sealing and cut-off stations and means of deforming at least one of the packaging webs into the moving cavities in order to prevent product migration on the web between the filling and scaling stations.

Prior art methods and devices such as shown by Brock, Smith and Lewi, supra, use apertured belts to support and transport in a straight line path semi-rigid plastic films which are thermally deformed to include five-sided depressions protruding through the apertures in the belt. In for instance the devices of Brock and Smith, the thermoformed depressions are sized so as to conform to and enter into positive driving engagement with the apertured belt. Lewi teaches the use of a system of hinged clamping elements arranged in the form of a belt to positively clamp and thereby drive the packaging webs through the thermoforming, filling, sealing, and cutting stations without requiring that the thermoformed depression enter into driving engagement with the apertured belt. In all three patents, product is introduced into the thermally deformed depressions and is prevented from migrating out of position by virtue of the sidewalls and depth of the depressions.

Mahaffy teaches the use of edge clamps to support and drive in a straight line path a semi-rigid pair of packaging webs through thermoforming, filling, sealing, and punching stations in lieu of an apertured belt as in Brock. Like Brock, the product introduced to the thermally deformed depressions is prevented from migrating out of position by virtue of the sidewalls and depth of the depressions and further, in the types of products to be packaged as cited by Mahaffy, by the cohesion between these moist products and the packaging webs.

Baumstingl teaches the use of cooperating half molds carded on chains and arranged in a belt-like manner to define product enveloping cavities in a tubular packaging web and to advance these cavities in a straight line path through cross sealing and cross-cutting stations which act on the packaging web between mated half molds. Moreover, Baumstingl uses the mated half molds to prevent the product from migrating out of position between the filling and sealing stations.

Limmer allows for product enveloping, vacuum ported mold cavities to be carried on a drum in a circular path or on a belt in a straight line path. In both cases, a first flexible packaging web is drawn by vacuum into a cavity which both prevents product migration and defines the seal boundary between the two packaging webs.

The product in our application is relatively thin and flat and our application requires that the packaging web be extremely soft and pliable. Such supple webs cannot be thermoformed to act as reliable web driving means as taught by Brock and Smith. Nor can such thin and supple webs be thermoformed to provide depressions to precisely maintain thin products in position as they are transported in a straight line path between the filling and sealing stations as taught by Lewi and Mahaffy. The mold cavities introduced in the devices according to Baumstingl and Limmer could be used to package thin, flat products in soft and pliable webs, but the additional cost and complexity of the molds and means to make the web conform to the mold are rendered unnecessary by the device according to our invention which instead uses the web tension between the two packaging webs as they are drawn over and apertured support drum to maintain product placement much more accurately than any of the prior art devices as it is transferred between the filling and sealing stations. None of the methods and devices using a straight line path between the filling and sealing stations can achieve a normal force between the two packaging webs and thereby hold the product in a precise position to the extent that our device achieves this end by wrapping the packaging webs over an apertured drum.

SUMMARY OF THE INVENTION

It is, therefore, an object of the invention to provide a method of packaging articles by applying tensioned webs thereto in a through opening.

It is another object of the invention to provide a method for packaging articles that provides for sealing and then relieving the packaged article from the through opening.

It is a feature of the invention that first and second webs are continuously tensioned prior to overwrappingly wrapping an article disposed in a through opening.

To accomplish these and other objects and advantages of the invention, there is provided, in one aspect of the invention, a method of packaging an article, comprising the step of providing a surface having at least one through opening which is generally somewhat larger than any one of the articles. Further, the step of providing a first and second source of first and second flexible webs, respectively is provided for by the method of the invention. One of the webs is first delivered to one of the through openings generally covering it and forming essentially a seat for the article. The article is then dispensed into the seat formed by the web in the through opening. Sequentially, the other web is then delivered to the through opening in an overlapping relations with the article and web therein. Portions of web overhanging the article seated in the through opening are sealed together forming a packaged article in the through opening. Finally, the sealed packaged article is relieved from the through opening and conveyed into the stream of commerce.

It is, therefore, an advantageous effect of the present invention that high speed continuous packaging, sealing and then singulating of articles can be achieved using webs which undergo continuous tensioning.

BRIEF DESCRIPTION OF THE DRAWINGS

The foregoing as well as other objects, features and advantages of this invention will become more apparent from the appended Figures, wherein like reference numerals denote like elements, and wherein:

FIG. 1(*a*) is a end view of the article illustrating its general flatness;

FIG. 3(*a*) is an enlarge view of a portion of FIG. 3;

DETAILED DESCRIPTION OF THE INVENTION

Figure 1:
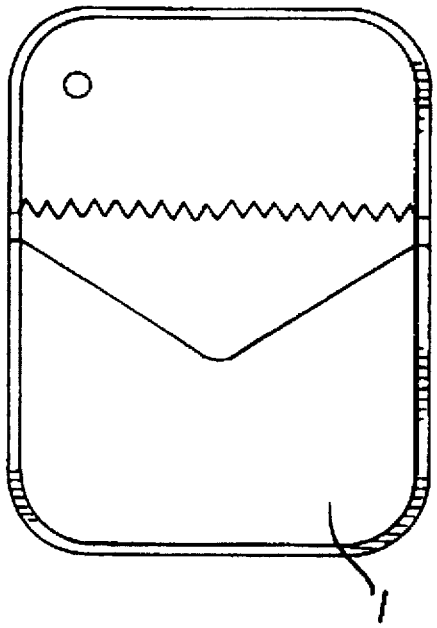
FIG. 1 a front view of a typical article or product to be packaged.
Figure 1A:
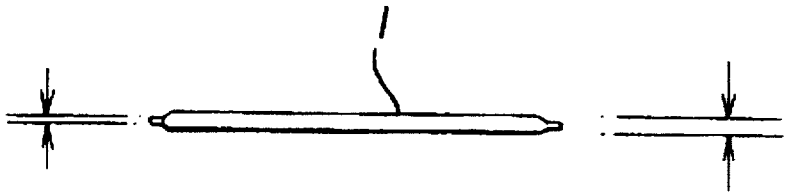

Turning first to FIGS. 1–1*a*, illustrated is an exemplary example of a typical article or product 1 capable of being packaged using the method of the invention. Briefly described, the article or product, 1, for instance a dental x-ray pack, is generally flat having a thickness of less than about 0.050 inches, as depicted in FIG. 1*a*. While the method of the invention can be used to package articles having a variety of geometric shapes, for instance round, triangular, etc., most of our experience has been largely with generally rectangular shaped articles.

Rotatable Drum 12

Figure 2:
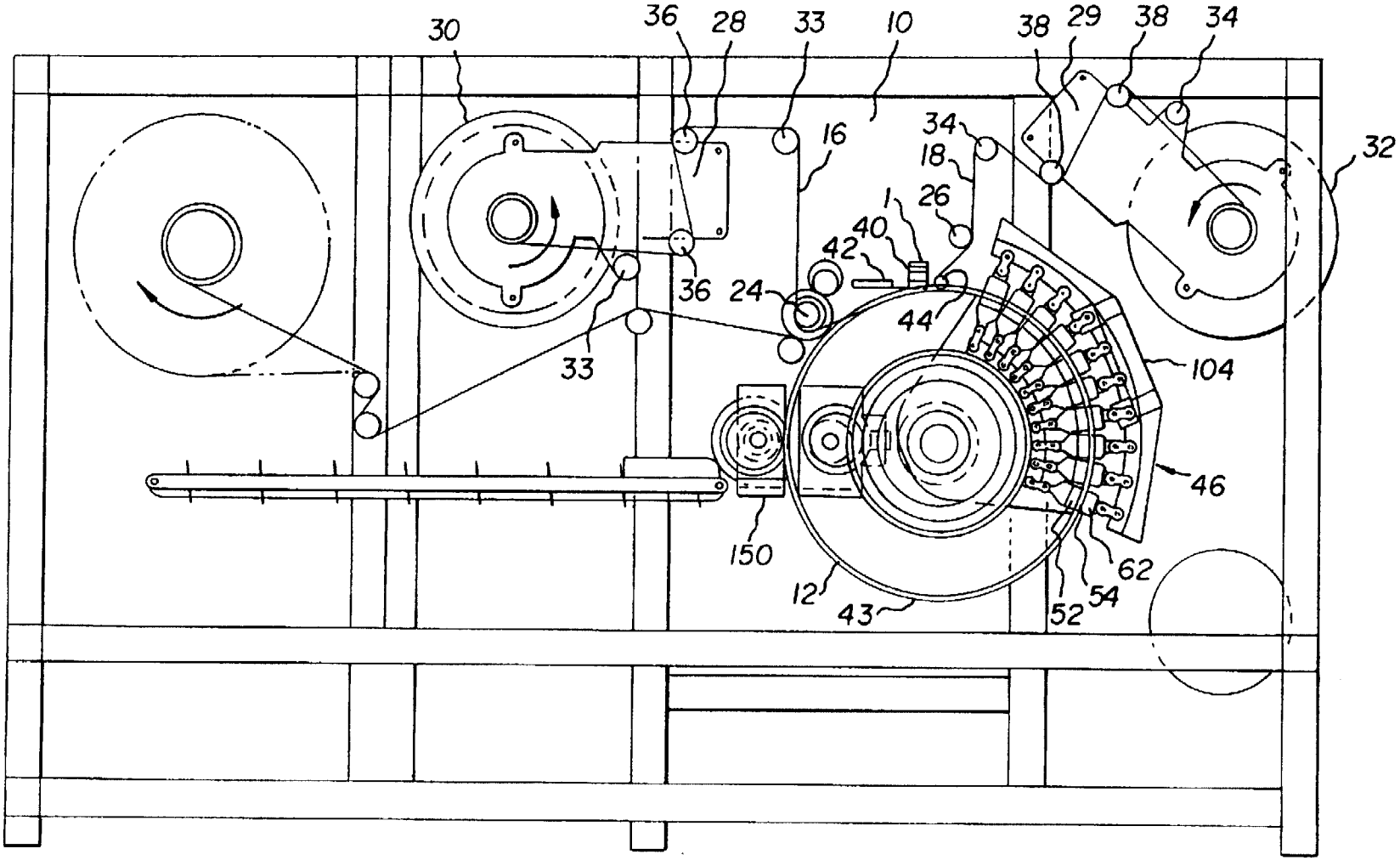
FIG. 2 is a front elevational view of exemplary apparatus that can be used to practice the method of the invention.
Figure 3:
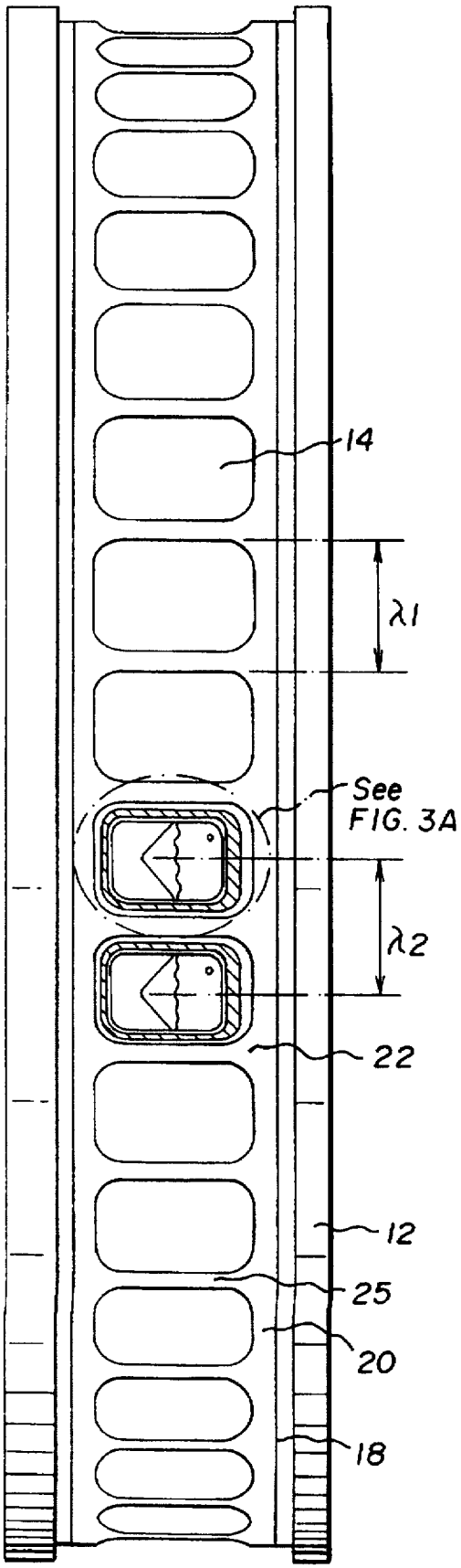
FIG. 3 is a top plan view of the drum circumference showing the article and web scaling region with the article enlarged to expose certain details thereof.
Figure 3A:
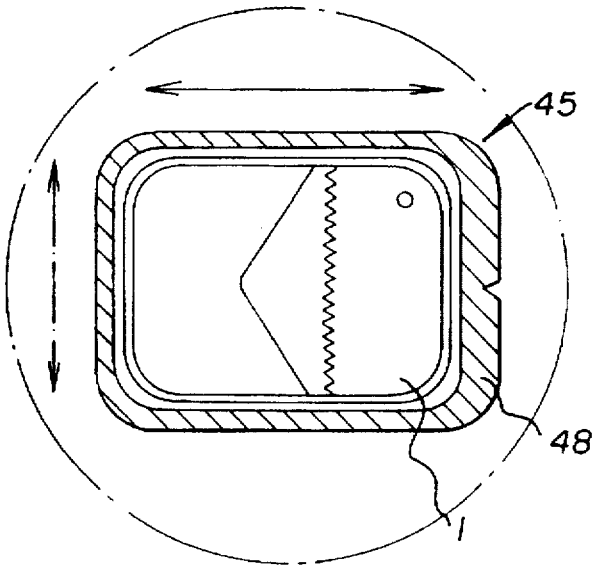

In FIGS. 2, 3, 4 and 9, an exemplary example of equipment 10 that can be used to practice the method in accordance with the principles is illustrated. FIG. 2 depicts a front view of equipment 10 having generally a rotatable drum 12 having through openings 14 for supporting a plurality of articles 1, first and second sources 30, 32 (described below) of first and second webs 16,18 provided under continuous tension for overwrapping each of the articles 1, means 46 (described below) for sealing the overwrapped webs 16,18 about the articles 1, and means 150 (described below) for relieving the articles 1 from the apertured drum 12. As best seen in FIG. 3, the drum 12 has a plurality of regularly spaced through openings or apertures, 14, surrounded by shoulder portions 20 aligned at least partially along a circumferential portion 22 of the drum 12. Each of the spaced through openings 14, in the preferred embodiment, is somewhat larger than each of the plurality of articles 1. Further, as depicted in FIG. 3, the through openings 14 are arranged in an array along the circumferential portion 22 of drum 12 according to a given pitch ($\lambda_1$) defined by the distance (1) between identical articles 1 similarly situated in adjacent through openings 14 along the circumferential portion 22 of the drum 12. In our application, we prefer accommodating about ten (10) articles 1 in through openings 14 arranged about the circumferential portion 22 of the drum 12 and spaced apart by a single pitch ($\lambda_1$) between a sealing cycle, described in details below. Alternatively, the method of the invention may be practiced using equipment, for instance, having an article support member (not shown) comprising adjoining through openings. The adjoining through openings may be arranged substantially linearly, such as in a chain-like array, or in a closed configuration, such as an oval or circle. In the case or a linear array of through openings, the array may be arranged vertically, horizontally or obliquely. It is important to the method of the invention that the through opening should accommodate the article arranged between overlapping webs.

According to FIG. 2, first and second lateral web guides 24,26 insure the correct lateral position of first and second webs 16,18, respectively, on the circumferential portion 22 of drum 12. Depicted in FIG. 3, either of the first or second webs 16,18 which eventually underlies one of the plurality of articles 1 seated in one of the plurality of through openings 14 is releasably secured to a shoulder portion 20 surrounding the through opening 14. We prefer using an adhesive coating 43 applied to the shoulder portions 20 to releasably secure the webs 16,18 to the shoulder portions 20. Alternatively, those skilled in the art will appreciate that other methods may be used to secure the webs 16,18 in position on shoulder portions 20, such as by vacuum (not shown). However, the adhesive coating, preferably 3M™ spray pressure sensitive adhesive, prevents slippage of the webs 24,26 relative to the shoulder portions 20 of the drum 12 as well as controls the shrinkage of the web 16,18 when they are heated during sealing, as described below.

Web Tensioning Means 28, 29, 30, 32, 33, 34, 36, 38

Shown clearly in FIG. 2, first and second sources 30,32 of first and second webs 16,18, respectively, are provided for supplying the respective webs 16,18 under continuous tension toward at least one of the plurality of spaced through openings 14. First and second webs 16,18 travel, in a preferred embodiment, though a respective serpentine path 28,29 formed by first and second idler roller 33,34 each being arranged to cooperate with first and second pivoting, tensioning idler rollers 36,38, respectively. Thus, preferably, first web 16 travels through serpentine path 28 formed by idler roller 33 cooperating with a pair of identical pivoting tensioning rollers 36, and then about another identical idler roller 33. Similarly, second 18 travels about serpentine path 29 romped by idler roller 34 which cooperates with a pair of identical pivoting tensioning rollers 38, and then about another identical idler roller 34. This arrangement of identical unwind rollers 33,34 and idler rollers 36,38, preferably upstream of the plurality of spaced through openings 14 in the circumferential portion 22 of the drum 12, produces the required level of continuous tension on the first and second webs 16,18. Of course, skilled artisans will appreciate that other means for tensioning the webs 16,18 are within the contemplation of the invention, including braking devices applied to the unwind spindle (not shown) and vacuum boxes (not shown). A preferred tensioning level (measured in pounds of tension per inch of web width or pli) of the webs 16,18 is one in the range of about 0.3 pli to about 1.3 pli. Consequently, taking into account the curvature of the circumferential portion 22 of the drum 12, and the continuous tension in the two incoming webs 16,18, a compressive force is thereby exerted on the product or article 1 by the overwrapped webs 16,18 which reliably holds the product or article 1 stably in place, centered in one of a plurality of through openings 14.

Figure 9:
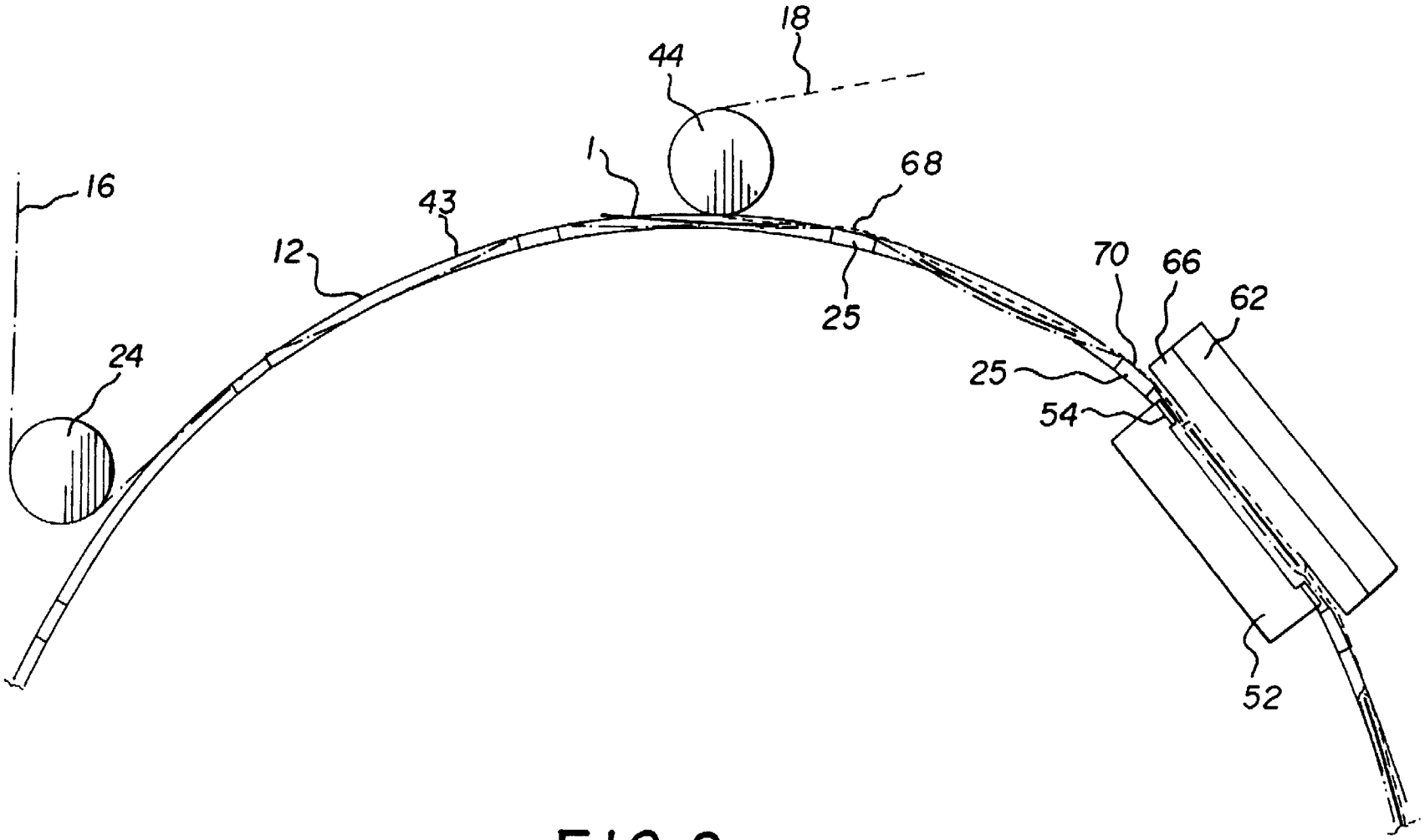

With reference to FIG. 2, since it is advantageous that equipment 10 continuously packages a plurality of articles 1, according to the invention, first and second webs 16,18 are arranged so as to be continuously delivered, in sequence, from its respective first and second source 30,32 toward one of the plurality of spaced through openings 14 of the drum 12. Either of the first and second webs 16,18 generally covers at least one of the plurality of through openings 14 when any one of the plurality of articles 1 is in proximity with one of the plurality of through openings 14. The other of the first and second webs 16,18 is then supplied in an overlapping relations about the article 1 thereby enveloping the article 1. In a preferred order, first web 16 is first delivered toward and into a through opening 14 with an extended portion of the first web 16 resting and adhering to the surrounding shoulder portions 20. An article dispenser (described below) then dispenses one of a plurality of articles 1 towards and into the through opening 14 such that the article rest on the first web 16. The second web 18, thereafter, is delivered towards and into the through opening 14 for overwrapping the article 1 nesting on the first web 16 and overlapping the first web 16, as shown in FIG. 9.

Article Dispenser 40

Figure 8:
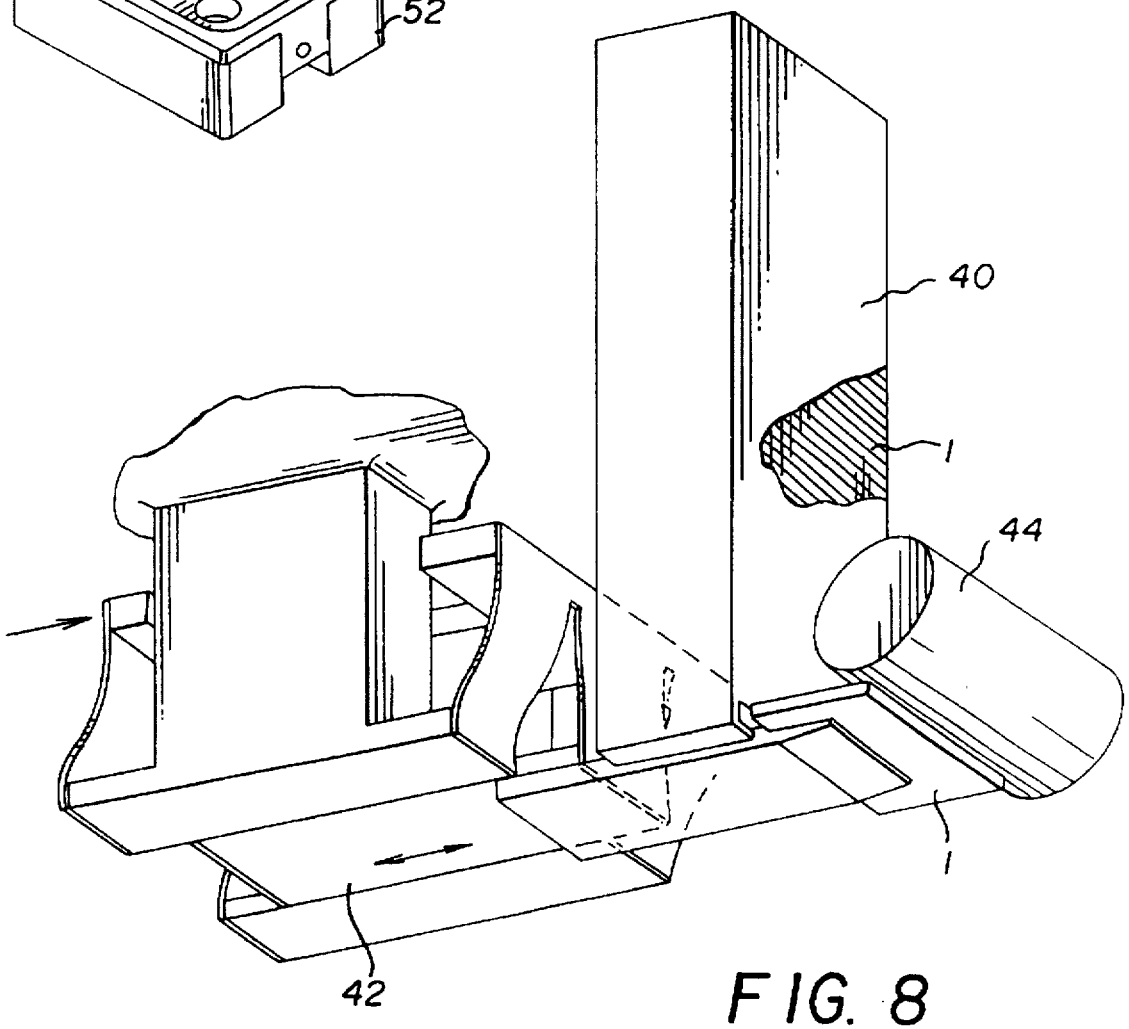
FIG. 8 is an isometric view of the article dispenser and reciprocating pusher elements, the former being partially tom away to expose articles therein; and, FIG. 9 is an enlarged end view of the drum illustrating an article-web wrapping stage.

In FIGS. 2 & 8, means, such as an article dispenser, 40, is arranged about the equipment 10 to introduce at least one of the plurality of articles 1 into proximity with one of the plurality of through openings 14. Clearly illustrated in FIG. 8, dispenser 40 comprises a sequencing means (not shown) to introduce at least one of the plurality of articles 1 when either of the first and second webs 16,18 generally covers the through opening 14 forming effectively a seat for the article 1 in the through opening 14.

Referring again to FIG. 8, articles 1 to be packaged are introduced between the first and second webs 16,18 at their point of convergence by a reciprocating pusher 42 which cooperates with article dispenser 40 and roller 44. A preferred reciprocating pusher device 42 contemplated by this invention is one disclosed in U.S. Pat. No. 5,293,782 by assigned to the Eastman Kodak Company, hereby incorporated herein by reference. The articles 1 are introduced at a predetermined pitch ($\lambda_2$), as shown in FIG. 3, which coincides with the pitch ($\lambda_1$) of through openings 14 arranged about the circumferential portion 22 of the drum 12. Pitch ($\lambda_2$) of the articles 1 is defined as the distance between articles 1 seated in adjacent through openings 14. In our invention, pitch ($\lambda_1$) is equal to pitch ($\lambda_2$).

Scaling Means 46

Figure 4:
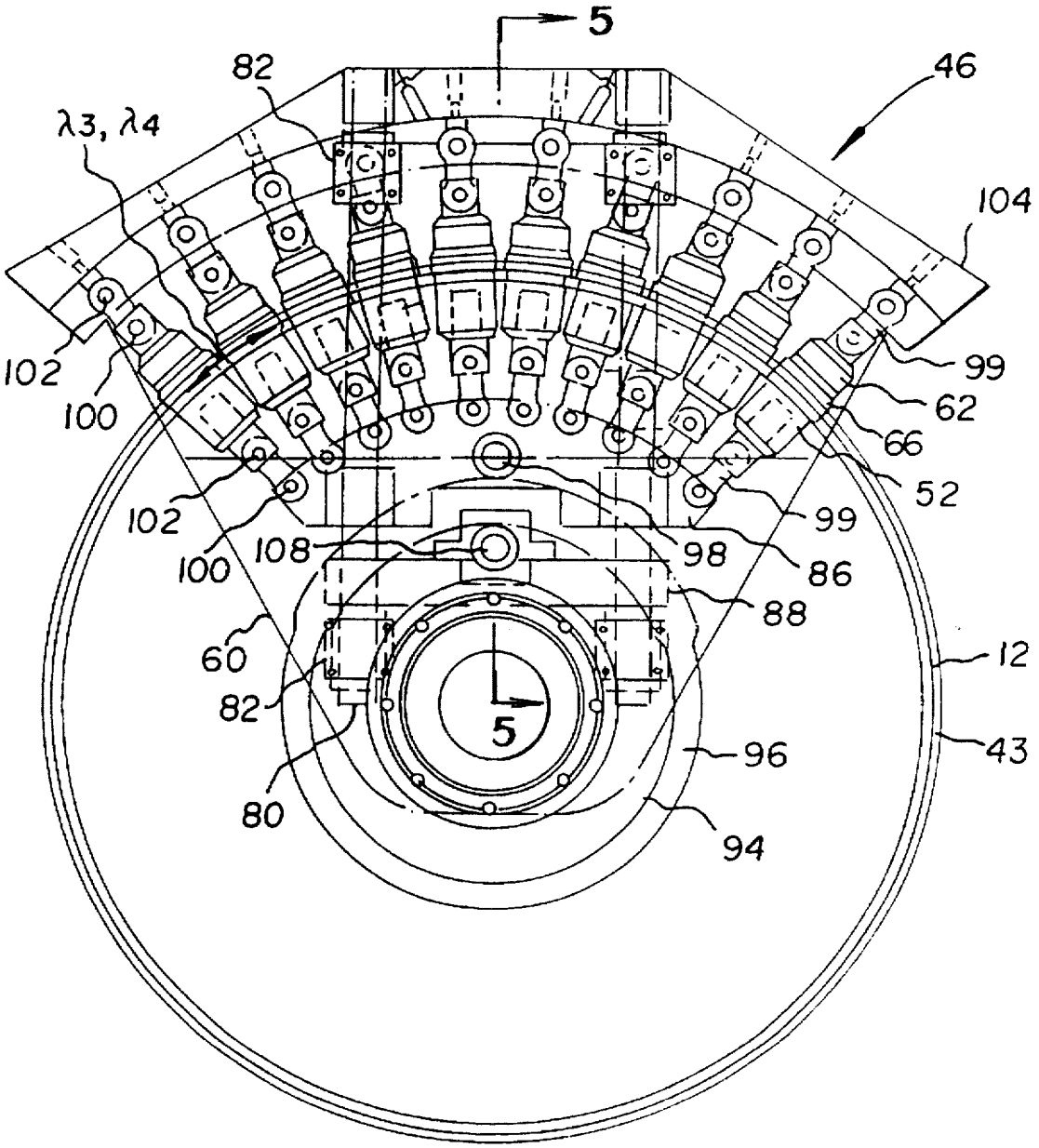
FIG. 4 is a detailed front elevational view showing the sealing element cooperating with the drum.

Referring to FIGS. 2 and 4, in the preferred embodiment, means 46 is provided for sealing the first and second webs 16,18 about each of the plurality of articles 1 seated in one of the plurality of through openings 14. Sealing means 46 forms sealed web portion 48 about the article 1 resulting in a sealed packaged article 45 (shown in FIG. 3 enlargement) suitable for shipment into the stream of commerce.

Figure 5:
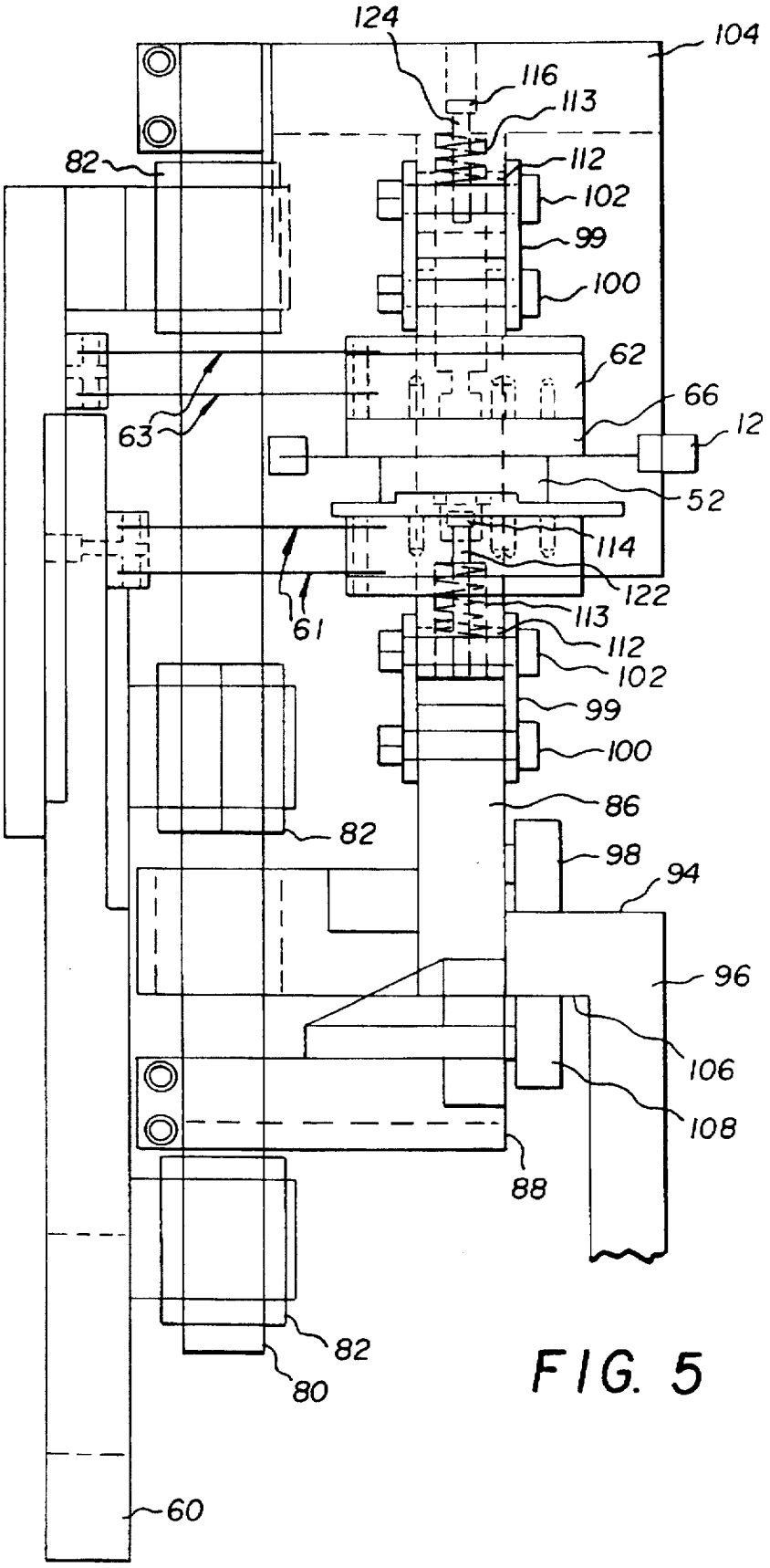
FIG. 5 is sectional view along line 5—5 of FIG. 4 showing the heating means in a closed position.
Figure 6:
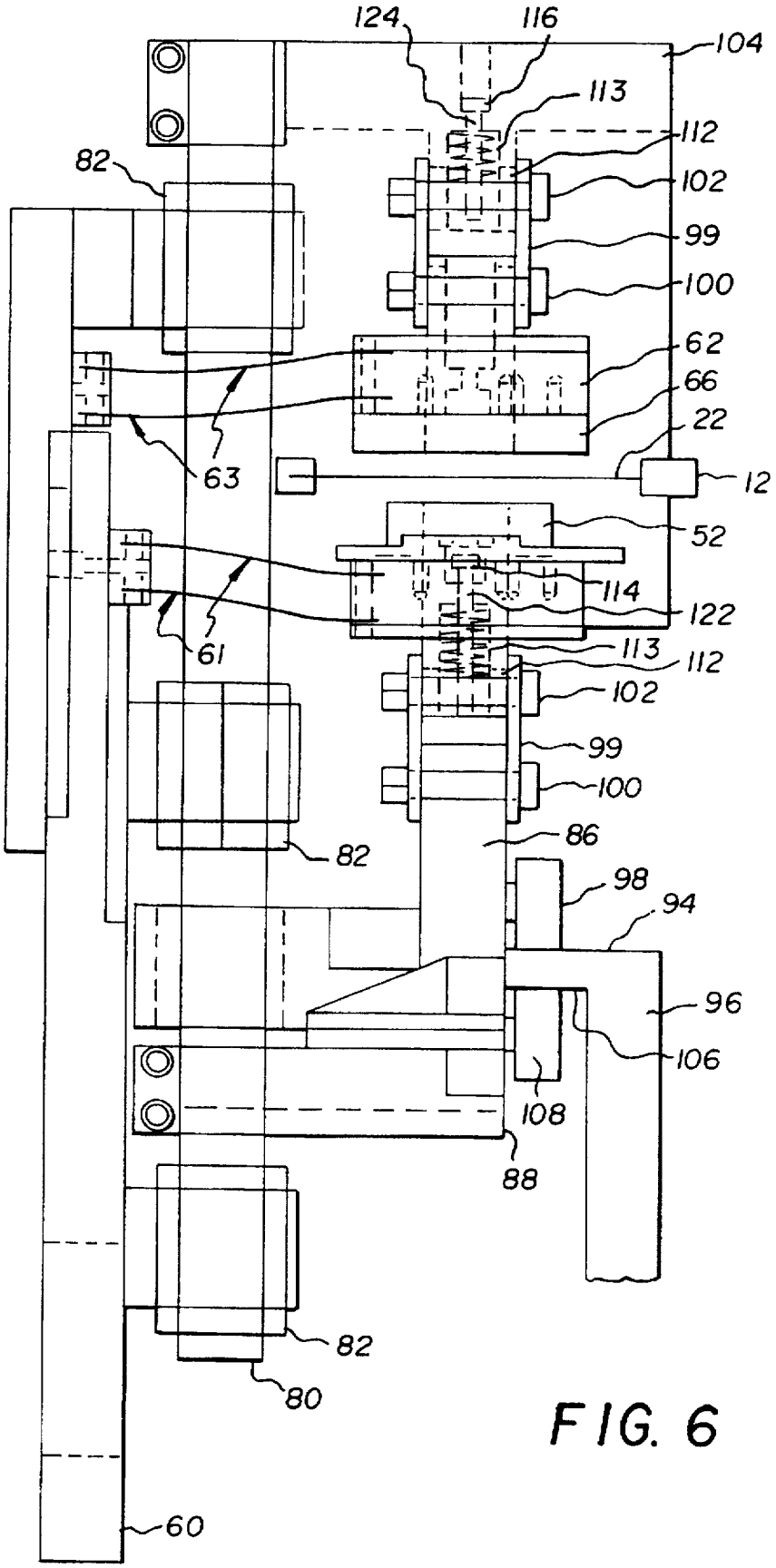
FIG. 6 is the same as FIG. 5 except that the heating means is in an open position.
Figure 7:
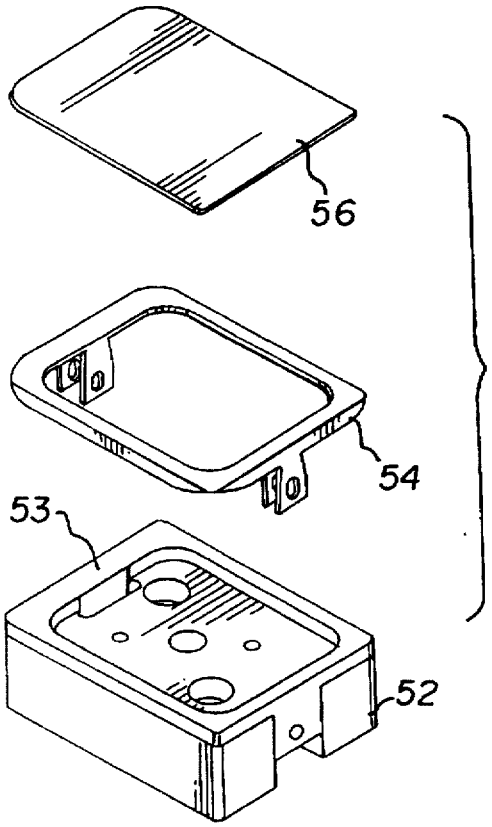
FIG. 7 is an exploded isometric view of the heating element.

According to FIGS. 5–7 and 9, either one of the first and second incoming webs 16,18 is contacted from underneath by a plurality of identical heater pads 52 which protrude at least partially into the apertures or spaced through openings 14 during a portion of the operating cycle of equipment 10. These heater pads 52 may be constructed of thermally and electrically insulating materials, such as composite glass fiber and epoxy or silicon resins, or ceramics such as zirconia, and alumina. Heater pads 52 may have recesses to accommodate the thickness of the product or article 1. Impulse heating elements 54, constructed preferably of nichrome or similar electrically conductive material, are mounted on their upper surfaces 53 (FIG. 7). A non-stick, high temperature tape 56 covers the impulse heating elements 54. The heater pads 52 are supported on an oscillating support arm 60 through identical first spring flexures 61 which allow each heater pad 52 to move in a radial direction toward and away from circumferential portion 22 of the drum 12. According to FIG. 4, pitch ($\lambda_3$) of the heater pads 52 is identical to the pitch ($\lambda_1$) of the spaced through openings 14 when the heater pads 52 are positioned for sealing the webs 16, 18 about the article 1 resting in the through opening 14.

Referring to FIGS. 4, 5 & 6, oscillating support arm 60 also supports a series of pressure pads 62 through second spring flexures 63 which guide the pressure pads 62 to move radially toward and away from the circumferential portion 22 of drum 12.

According to FIG. 4, the pitch ($\lambda_4$) of the pressure pads 62, defined as the distance between adjacent spaced pressure pads 62, is identical to the pitch ($\lambda_1$) of the through openings 14 in the circumferential portion 22 of the drum 12 when the support pads 62 are in engagement with the incoming first and second webs 16,18. As depicted in FIG. 4, the support pads 62 have an elastomeric covering 66, preferably composed of closed cell silicone foam in order to present a compliant and non-stick surface to the incoming first and second webs 16,18. The compliancy of the elastomeric covering 66 insures good seal uniformity in the incoming first and second webs 16,18 about the article 1 despite slight non-uniformities in contact pressure between the pressure pads 62 and the heater pads 52. The pressure pads 62 are generally narrower than each of the through openings 14 in circumferential portion 22 in the transverse direction (denoted solid arrow in FIG. 3) and are larger than the openings 14 in the circumferential direction (denoted by broken arrow in FIG. 3). This allows the preferably flat faced pressure pads 62 to more closely conform to the incoming first and second webs 16,18 which become chordal segments as they span the through openings 14 and stops the motion of the spring loaded pressure pads 62 at a consistent radial position relative to the input webs 16,18 despite radial runout of the webs 16,18 enveloping one of a plurality of articles seated in a through opening 14 of circumferential portion 22. Elastomeric covering 66 in the circumferential direction (shown by broken arrows in FIG. 3) serves to clamp the webs 16,18 against extended portions 68,70 of first and second webs 16,18 arranged about the transverse shoulder portions 28 surrounding the spaced openings 14 in the circumferential portion 22 to limit shrinkage and subsequent wrinkle formation in the incoming first and second webs 16,18 as they arc being sealed.

In FIGS. 4–6, a pair of identical linear guide rods 80 slidably mounted in guide bearings 82 and mounted to one face of oscillating support arm 60 support actuator blocks 86, 88 for linear movement in a radial direction. Actuator block 86 is driven toward and away from circumferential portion 22 of dram 12 along guide rods 80 by first cam profile 94 of cam 96 through cam follower 98. Actuator block 86 simultaneously drives each of heater pads 52 into and out of spring loaded engagement with the incoming webs 16,18 and the pressure pads 62 through links 99 which pivot about pins 100,102. Actuator block 88 is clamped to guide rods 80 and causes support arch 104 to move in a radial direction toward and away from circumferential portion 22 through second cam profile 104 of cam 96 acting against second cam follower 108. Support Arch 104 simultaneously drives each of pressure pads 62 into and out of spring loaded engagement with the input webs 16,18, the heater pads 52 and the circumferential portion 22 of drum 12 in order to effect an annular seal band in the two input webs 16,18 which captures the product or article 1 inside of the annular sealed web portion 48, as seen in FIG. 3.

Further, according to FIGS. 4–6, pressure pads 62 and heater pads 52 employ a preloaded spring tensioning system (not shown) to insure that a consistent desired clamping force is achieved between the heater pads 52 and support pads 62. Moreover, the proloaded spring system insures that the input webs 16,18 are neither pushed excessively into the through openings 14 nor pulled away from the circumferential portion 22 despite its radial runout and set-up inaccuracies in the preferred heights of the heating pads 52 and pressure pads 62. This is accomplished by having pins 102 captured in slots 112 in heater pads 52 and arch 104 which allow radial motion of the heater pads 52 and pressure pads 62 with respect to their actuators 86,88, respectively, through the use of identical preloading springs 113 which exert a predetermined force against heating pads 52 and pins 102 and between arch 104 and pins 102, forcing the heating pads 52 against heads 114,116 of height adjustment screw 122,124, respectively. When cam 96 activates the heater pads 52 and pressure pads 62 to clamp against both the first and second webs 16,18, the timing of first and second cam profiles 94,106 is such that the pressure pads 62 contact the outer surface of the drum 12 before the heater pads 52 contact the first and second webs 16,18. Skilled artisans can also appreciate that the first and second webs may be sealed by pressure pads 62 contacting either one of the webs 16,18 when the webs 16,18 envelop the article 1 in the through opening 14. Support arch 104 is displaced more than the distance required to cause contact between the pressure pads 62 and the circumferential portion 22 of drum 12 so as to unseat the head 116 of height adjustment screws 124 and thereby cause each pressure pad 62 to bear against the transverse shoulder portions 25 of the circumferential portion 22 between spaced through openings 14 with a predetermined force. Actuator block 86 similarly is overdriven so as to unseat the heads 114 of height adjustment screws 122 and thereby cause each heater pad 52 to contact the webs 16,18 and bear against the elastomeric face of pressure pads 62 with a preset contact force.

Referring once again to FIGS. 4–6, oscillator support arm 60 is made to oscillate through an arc of about 60 degrees by a commercially available cam driven actuator (not shown). The oscillator support arm 60 is configured such that it maintains a constant angular velocity over an output displacement of 50 degrees for a constant input velocity and over 180 degrees of input rotation. The constant angular velocity portion of the oscillator cycle is made to correspond exactly to the angular velocity of the circumferential portion 22 by a system of drive pulleys so that the heater pads 52 and pressure pads 62 may cooperate to form a sealed web portion 48 between the webs 16,18 through the through openings 14 in circumferential portion 22 of drum 12. Moreover, according to FIGS. 4–6, Cam 96 is driven through a system of drive pulleys (not shown) to make one revolution per oscillator cycle and is contoured to activate the heater pads 52 and pressure pads 62 to clamp the input webs 16,18 together for sealing during the constant angular velocity portion of the oscillator's cycle and to disengage from the webs 16,18 at the end of the constant velocity portion of the oscillator's movement. In this way, the heater pads 52 and pressure pads 62 are able to join the two webs 16,18 and maintain a constant pressure on the sealed web portion 48 while it cools in order to effect a high quality seal in webs 16,18 having low tack strength.

Article Relieving Means 150

According to FIG. 2, important to the invention, means 150 is provided for relieving the sealed packaged article 45 from the each of the spaced through openings 14. In the preferred embodiment, relieving means, or alternately punch device, 150, such as a knife or any cutting member, is adapted to relieve the tolerances of the through openings 14. A preferred punch device 150 is one disclosed in Research Disclosure 38195, Publication 196, page 81 which describes a punching device with a cycle inhibitor. The aforementioned preferred punch device 150 in cooperation with a variable cycloidal indexing device, described and disclosed in U.S. Ser. No. 08/572,374, by the inventors Michael Long and James White, assigned to the Eastman Kodak Company, and hereby incorporated herein by reference, would then enable the sealed packaged article 1 to be sequentially relieved from the spaced openings 14 and conveyed away from the operation for shipment into the stream of commerce.

As seen in FIG. 3, webs 16,18 remain adhered to shoulder portions 20,25 surrounding the through openings 14 of drum 12 after sealing and is transported to a subsequent operation in perfect registration with the through openings 14. In our application, a moving punch press 150 (FIG. 2) having cooperating punching or cutting tooling (not shown) is brought into velocity matching engagement with the drum 12 and hence the sealed input webs 16,18 to cut the webs 16,18 to cut the packaged product 45 from the joined webs 16,18 through the through openings 14. Further, circumferential portion 22 of drum 12 cooperates with the sealing and punching processes to hold the input webs 16,18 and the article 1 to be packaged in a repeatable position relative to these devices and to maintain pitch registration between these and possibly several additional processes, but does not contact the heater pads 52, punch press 150 or packaged product 45. This attribute minimizes the possibility of contaminating the packaged product 45 and enables multiple product formats varying in size, shape, and thickness to be packaged using the equipment 10 of the invention and without changing the configuration of spaced through openings 14 in circumferential portion 22.

Parts List

1 . . . article or product
10 . . . equipment
12 . . . drum
14 . . . through openings
16, 18 . . . first and second webs
20 . . . shoulder portions
22 . . . circumferential portion of drum 12
24, 26 . . . first & second lateral web guides
25 . . . tranverse shoulder portion
28,29 . . . first and second serpentine paths
30, 32 . . . first and second sources of first & second webs, respectively.
33, 34 . . . first & second unwind roller
36, 38 . . . first & second idler rollers
40 . . . article dispenser
42 . . . reciprocating pusher
43 . . . adhesive coating
44 . . . roller
46 . . . sealing means
45 . . . packaged article or product

48 . . . sealed web portion
52 . . . heater pads
53 . . . upper surface of heater pad 52
54 . . . heating elements
56 . . . high temperature tape
60 . . . oscillating support arm
61,63 . . . first and second spring flexures
62 . . . support pads/pressure pads
66 . . . elastomeric covering
68,70 . . . extended portions of first and second webs, respectively.
80 . . . linear guide rods
82 . . . guide bearings
86,88 . . . support actuator blocks
94,106 . . . first and second cam profiles or laces
96 . . . cam
98 . . . first cam follower
99 . . . links
100,102 . . . pins
104 . . . support arch
108 . . . second cam follower
112 . . . slots
113 . . . preloading springs
114, 116 . . . heads of height adjusting screws 122, 124, respectively.
122, 124 . . . height adjustment screws
150 . . . article relieving means While the invention has been described with a certain degree of particularity, it is manifest that many changes may be made in the details of the construction and the arrangement of components without departing from the spirit and scope of the disclosure. It is understood that the invention is not limited to the embodiments set forth herein for purposes of exemplification, but is to be limited only by the scope of the attached claim or claims, including the full range of equivalency to which each element thereof is entitled.

We claim:

1. Method of packaging an article, comprising the steps of:

providing a rotary drum with a surface having at least one through opening, said through opening having open opposite ends and being generally somewhat larger than said article;

providing a first and second source of first and second flexible webs, respectively, capable of delivering said first and second webs to said through opening in said surface;

providing means for sequentially supplying the first and second flexible webs into the through opening from said first and second source;

providing means for dispensing said article into said through opening;

supplying said first flexible web into said through opening, said first flexible web being supplied so as to generally cover said through opening to form a first packaging layer;

dispensing said article onto said first packaging layer, said first packaging layer supporting said article in said through opening, and wherein said article and said first packaging layer defining a partially packaged article;

supplying said second flexible web onto said partially packaged article in an overlapping relations with said first flexible web, said second flexible web forming a second packaging layer about said article, and wherein portions of said first and second flexible webs overhang said article;

sealing while under constant pressure said portions of said first flexible web overhanging said article to said portions of said second flexible web overhanging said article to form a sealed packaged article; and, removing said sealed package article from said through opening.

2. The method recited in claim 1, wherein said step of providing a first and second source includes the step of introducing tension in said first and second webs prior to supplying said webs to said through opening.

3. The method recited in claim 2, wherein said step of introducing tension includes providing a serpentine travel path for each of said first and second webs prior to delivery to said surface, each of said serpentine paths having a plurality of biased idler rollers arranged for introducing specific tension in each of said first and second webs.

4. The method recited in claim 3, wherein said specific tension in both said first and second webs is in the range of about 0.3 pli to about 1.3 pli.

5. The method recited in claim 4, wherein the specific tension in said first web equals the tension in said second web.

* * * * *